United States Patent [19]

King

[11] Patent Number: 4,667,938

[45] Date of Patent: May 26, 1987

[54] ROCKER ARM/SPRING ASSEMBLY

[75] Inventor: Patrick D. King, Rantoul, Ill.

[73] Assignee: Flo-Con Systems, Inc., Champaign, Ill.

[21] Appl. No.: 797,994

[22] Filed: Nov. 14, 1985

[51] Int. Cl.[4] ..... B22D 41/08

[52] U.S. Cl. ..... 266/271; 266/287; 222/600

[58] Field of Search ..... 266/287, 236, 271, 272; 222/600, 590; 248/222.4

[56] References Cited

U.S. PATENT DOCUMENTS

| | | | |
|---|---|---|---|
| Re. 27,237 | 11/1971 | Shapland | 222/600 |
| 3,270,995 | 9/1966 | Shears | 248/222.4 |
| 3,918,613 | 11/1975 | Shapland, Jr. | 222/600 |
| 4,253,647 | 3/1981 | Andres | 266/287 |
| 4,545,512 | 10/1985 | Shapland et al. | 222/600 |

*Primary Examiner*—L. Dewayne Rutledge
*Assistant Examiner*—S. Kastler
*Attorney, Agent, or Firm*—Jack E. Dominik

[57] ABSTRACT

A rocker arm/spring assembly which can be readily removed without the use of any tools whenever the refractory is removed from the valve is disclosed. Since the refractory is regularly removed from the valve, the rocker arm and spring assembly can be removed, and the springs replaced and tested readily. The rocker arm is provided with a keyhole mount including a bolt shank slot, a seat bore, a bolt head port, and a bolt spherical head seat. The rocker bolt is secured to the frame and has a spherical head which is slightly smaller than the bolt head port which permits the rocker arm to be passed over the fixed head of the rocker bolt, and then shifted laterally until the shank of the rocker bolt is nested within the bolt shank slot of the rocker arm, and the spherical head of the bolt engages the spherical head seat in the underportion of the rocker arm. The spring is nested within a spring assembly bore which is of essentially uniform diameter, with a spring pad at the bottom portion having a spring pad shank to receive a coiled spring, and terminates in a spring seat at its upper portion. Thus the spring and pad assembly are inserted into the spring assembly bore prior to the rocker arm being positioned and thereafter all is secured in place when the refractories are under pressure.

5 Claims, 10 Drawing Figures

ROCKER ARM/SPRING ASSEMBLY

FIELD OF THE INVENTION

The present invention relates to a rocker arm spring assembly for use in a valve of the sliding gate variety. A typical such valve is illustrated in Reissue U.S. Pat. No. Re. 27,237 owned by the assignee of this invention.

SUMMARY OF THE PRIOR ART

The prior art will be explained in greater detail in the body of the application where the environment is described. Basically, however, the prior art as illustrated by U.S. Pat. No. Re. 27,237 utilizes a spring and pad assembly to engage a rocker arm, the rocker arm being pivoted so that one end engages and applies pressure to the bottom plate of the sliding gate assembly, and the other end is engaged by the spring. Such units traditionally have been securely mounted within the frame of the sliding gate valve, and neither the rocker arm nor the spring assembly could be removed without removing the valve from the mounting plate. It will be appreciated that spring loaded elements located in close proximity to teeming metal such as steel require cooling, and are susceptible of failure. With the prior art, springs could not be readily inspected and replaced, and accordingly the risk of uneven load distribution between a plurality of springs and rocker arms engaging the rails of a bottom plate of a sliding gate valve.

SUMMARY OF THE INVENTION

The present invention is directed to a rocker arm/-spring assembly which can be readily removed without the use of any tools whenever the refractory is removed from the valve. Since the refractory is regularly removed from the valve, the rocker arm and spring assembly can be removed, and the springs replaced and tested readily. The rocker arm is provided with a keyhole mount including a bolt shank slot, a seat bore, a bolt head port, and a bolt spherical head seat. The rocker bolt is secured to the frame and has a spherical head which is slightly smaller than the bolt head port which permits the rocker arm to be passed over the fixed head of the rocker bolt, and then shifted laterally until the shank of the rocker bolt is nested within the bolt shank slot of the rocker arm, and the spherical head of the bolt engages the spherical head seat in the underportion of the rocker arm. The spring is nested within a spring assembly bore which is of essentially uniform diameter, with a spring pad at the bottom portion having a spring pad shank to receive a spring, and terminates in a spring seat at its upper portion. Thus the spring and pad assembly are inserted into the spring assembly prior to the rocker arm being positioned and thereafter all is secured in place when the refractories are under pressure.

In view of the foregoing it is a principle object of the present invention to provide a rocker arm/spring assembly which can be readily removed anytime the refractory is removed from the sliding gate valve, and without the use of any tools attributable to the keyhole mount provided in the rocker arm. A related advantage is that the springs and rockers can be inspected everytime the valve is shut down for a refractory replacement rather than having to remove the entire valve from the mounting plate.

A further object of the present invention is to provide a rocker arm/spring assembly affording the aforesaid advantages which can be retrofitted into existing valves, and which with a new valve, does not materially effect the cost of manufacture.

BRIEF DESCRIPTION OF THE DRAWINGS

Further objects and advantages of the present invention will become apparent as the following description proceeds, taken in conjunction with the accompanying drawings, in which.

DETAILED DESCRIPTION OF A PREFERRED EMBODIMENT

The Prior Art

Figure 1:
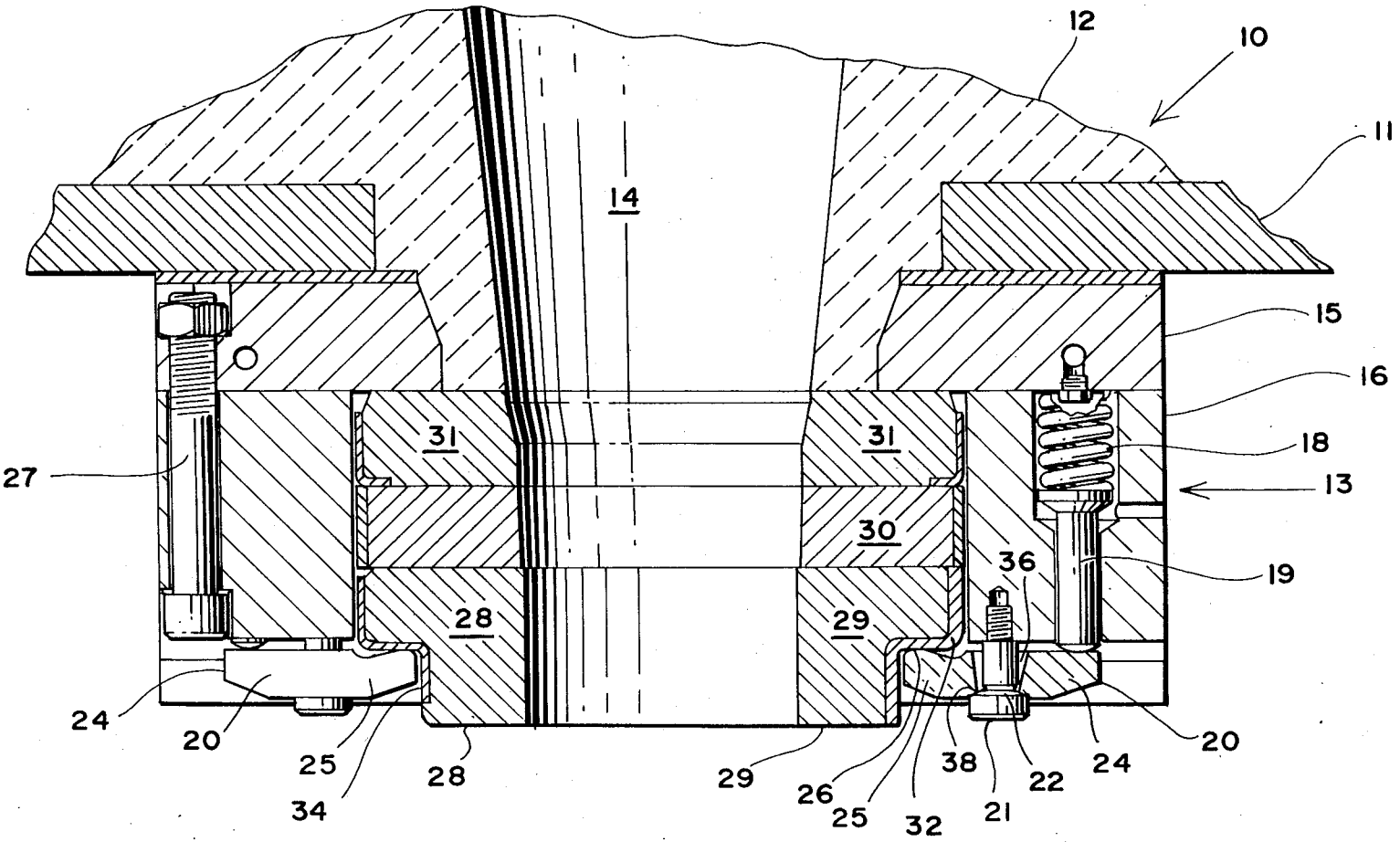
FIG. 1 is a transverse sectional view of a typical sliding gate valve of the prior art showing on the right-hand side the spring and rocker arm assembly. The drawing is split to show a mold plate carrier on the right-hand side and an interface plate on the left-hand side.

Turning now to FIG. 1, the prior art is exemplified at the base of a typical tundish 10 which has a tundish plate 11 containing a tundish refractory lining 12. A teeming opening 14 is provided in the central base portion of the tundish 10 which is in open communication with a tundish sliding gage valve assembly 13. A mounting plate 15 secures the valve 13 to the tundish plate 11. Beneath the mounting plate, a frame 16 is provided to support the several refractories involved.

Interiorly of the frame 16 openings are provided to mount a spring 18 which has a spring pad 19 extending downwardly to engage a rocker arm 20. As will be seen, the spring 18 is burried in a recess, and the spring pad travels through a hole in the frame 16 which is of smaller diameter than the recess which houses the spring 18. The rocker arm 20 is secured in place for shiftable operation by a rocker bolt 21 which has a spherical head 22. A spring pad arm 24 extends from one side of the rocker arm 20, and a plate arm 25 extends from the other side. The plate arm includes a rail pad 26 which engages the rail 32 of the mold carrier plate 29. Similarly the interface plate 28 as shown in the left-hand portion of FIG. 1 is engaged by its corresponding rocker arm 20. To be noted is the positioning of the sliding plate 30, the top plate 31 and the interface plates/mold carrier plates 28, 29. Upon removal of any of the refractory, if it is desired to remove and inspect the spring 18, it will be seen that the frame 16 must be unbolted by means of removing the mounting bolt as shown in the left-hand side of FIG. 1. Finally note that the rocker bolt 21 has a spherical head which engages beneath the rocker port 36 in the rocker arm, a spherical seat 38.

Illustrative Embodiment

Figure 2:
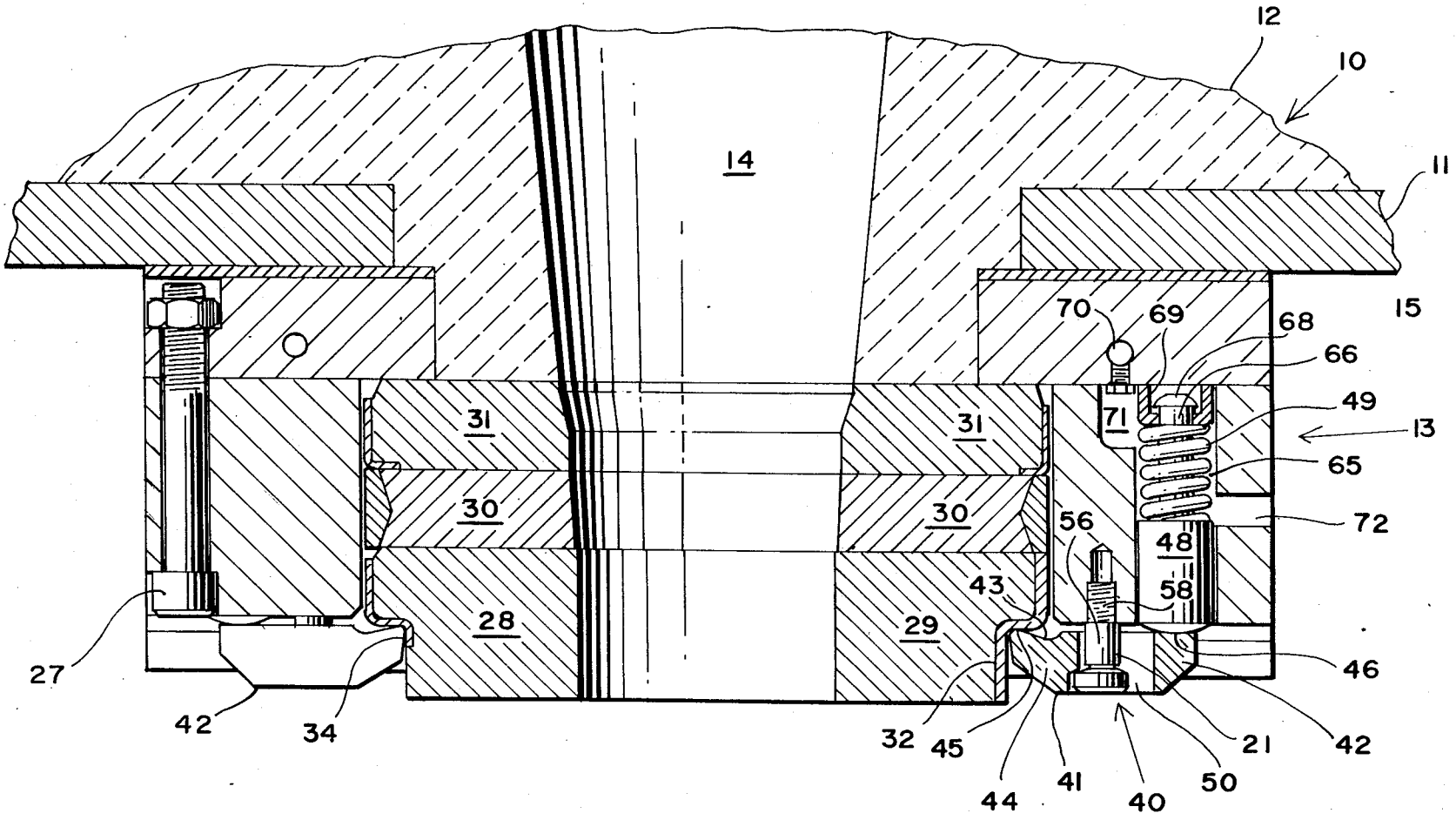
FIG. 2 is a transverse sectional view in the same scale as FIG. 1 showing the removable rocker arm and spring assembly at the right-hand side and illustrating by comparison with FIG. 1 the extent to which the two assemblies are compatible.

Referring now to FIG. 2, common reference numerals and parts with the prior art will not be described in detail other than to show the ease and ability of the removable arm and spring assembly 40 to be retrofitted, as well as to be employed in a basic valve 13. The improved rocker arm 41 has a spring pad arm 42 defined by a recess 43 in the spring pad arm. A rail arm 44 with a rail pad 45 extends in the opposite direction. To be noted is a spring pad face 46 for engaging the spring pad 48 which, in turn, mounts the spring 49.

The advantageous features of the invention are achieved by the keyhole mount 50 provided in the rocker arm 41. More specifically, by reference to FIGS. 3, 4 and 5, it will be seen that the keyhole mount 50 includes a bolt shank slot 51, and a bolt spherical head seat 52. A seat bore 54 is provided underneath the bolt shank slot, and laterally therefrom provision is made for a bolt head port 55. The bolt shank 56 (see FIG. 6) is of a diameter to pass through the bolt shank slot 51. The bolt head 22 is of a diameter sufficient to pass through the bolt head port 55. As with the prior art, a thread 58 is provided at the end of the rocker bolt to secure the same within the frame 16. The bolt head 22 is activated by the hex recess 59 in the head.

Figure 8:
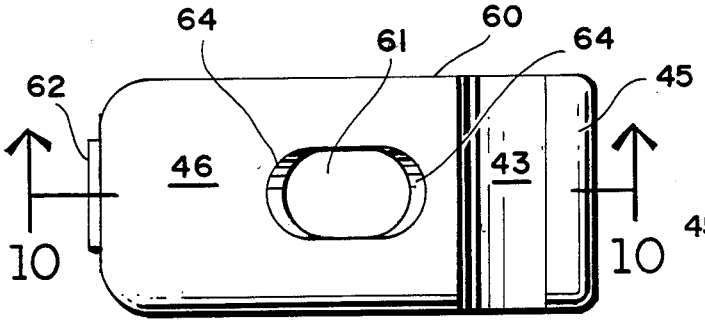
FIG. 8 is a plan view of the rocker casting.
Figure 9:
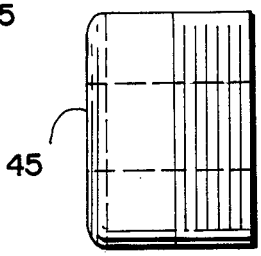
FIG. 9 is an end view of the rocker casting showing in dotted lines the shank slot.
Figure 10:
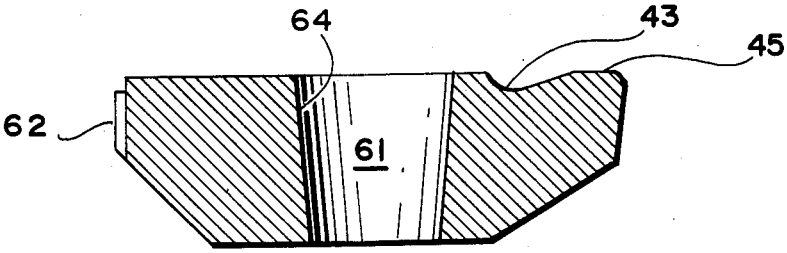
FIG. 10 is a longitudinal sectional view of the rocker arm casting as shown in FIG. 8 taken along section line 10—10 of FIG. 8.

Further details of the rocker arm will be appreciated by reference to the preliminary casting 60 as shown in FIGS. 8–10 inclusive. There it will be seen that a shank slot 61 is formed with tapered ends 64, and terminates in a sprew 62 at one side from which the casting is poured. Normally the taper of the ends 64 is approximately 5°. There is no taper provided in the center, as will be seen from the dotted lines in FIG. 9.

Figure 3:
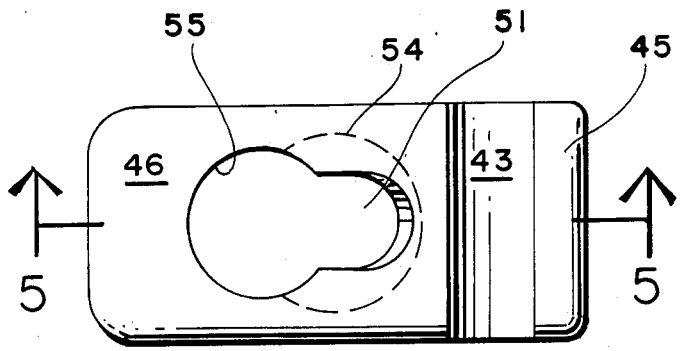
FIG. 3 is a top view of the removable rocker arm.
Figure 4:
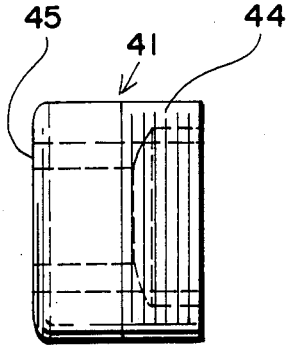
FIG. 4 is an end view of the removable rocker arm showing in dotted lines the key slot and the main bolt head port.
Figure 5:
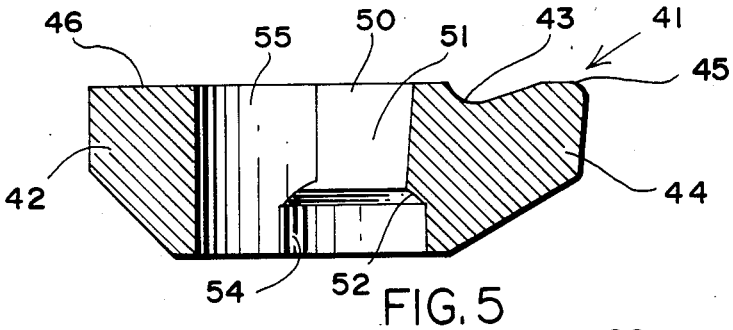
FIG. 5 is a longitudinal section of the rocker arm shown in FIG. 3 taken along section line 5—5 of FIG. 3.
Figure 7:
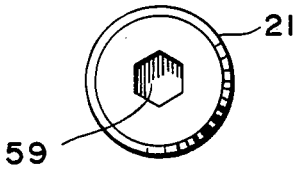
FIG. 7 is an end view of the rocker bolt shown in FIG. 6.
Figure 6:
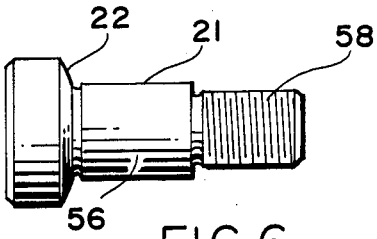
FIG. 6 is a front elevation of the rocker bolt.

Once the casting 60 has been completed, it is machined to the configuration shown in FIGS. 3, 4 and 5. Typically this is done by grinding the top surface of the rocker, then positioning the rocker in a spherical fixture and the keyhole is machined by first machining the bolt head port 55 and then machining the bolt spherical head seat 52 at the base of the bolt shank slot 51 at the bottom of the machined seat bore 54. The sprew 62 is ground off by conventional techniques. In a typical commercial embodiment a spherical radius of 1.25 inches is used to form the bolt spherical head seat 52. As will be seen particularly from FIG. 4, the spherical seat 52 underlies the bolt shank slot 51, and as shown in FIG. 3, the seat encircles considerably more than 180° of the bolt shank slot, the amount approximating 270°.

Turning now to FIG. 2, it will be seen that a spring assembly bore 65 of constant diameter is provided in the frame 16 from the lower portion of the frame to the mounting plate 15. A spring pad shank 66 extends upwardly from the spring pad 48, and is encircled by the spring 49. A shank head 68 is provided on the far end of the spring pad shank 66, and nests within a cup-shaped inverted spring seat 69. Thus once the rocker arm 40 is no longer carrying the load of the refractory elements 29, 30, 31, the rocker arm is free to shift laterally, and the spring pad 48 and its spring drop out of the spring assembly bore 65.

Finally all of the above is achieved without sacrificing the cooling of the spring 49, since the air manifold 70 connects with the air bypass 71 much as disclosed with the prior art in FIG. 1. The air then passes through the spring assembly bore 65, and diverts outwardly through the exhaust port 72.

Although particular embodiments of the invention have been shown and described in full here, there is no intention to thereby limit the invention to the details of such embodiments. On the contrary, the intention is to cover all modifications, alternatives, embodiments, usages and equivalents as fall within the spirit and scope of the present invention, specification, and appended claims.

What is claimed is:

1. A rocker arm spring assembly in a sliding gate valve comprising, in combination, a rocker arm having a rail engaging portion, spherically headed bolt means for mounting the rocker arm to a frame, a spring, a spring pad assembly engaging the spring and the end of the rocker arm opposite the rail engaging portion, said rocker arm being characterized by a keyhole slot having a spherical mounting seat beneath a mounting bolt shank slot to removably securably coact with the spherically headed bolt, said spring being carried by a spring pad and shank, said spring and spring pad having a substantially similar cylindrical diameter, wherein the rocker arm and its mounting means are proportioned to lock the rocker arm for limited pivotal motion about a fixed axis in the loaded configuration and yet permit removal of the rocker arm only in the unloaded configuration, whereby the spring assembly may be inserted in a frame bore and the rocker engaging the spring and a rail with the rocker assembly secured by its mounting on the spherically headed bolt through the keyhole slot.

2. In a rocker arm spring assembly for use with a sliding gate valve, a spherical headed bolt for mounting a rocker arm to the frame, a spring, a spring pad assembly engaging the spring and the end proportioned to engage a rocker arm, the spring being carried by a spring pad shank, and a spring and spring pad having substantially similar cylindrical diameter, the improvement comprising a rocker arm, said rocker arm being characterized by a keyhole slot having a spherical mounting seat beneath a mounting bolt shank slot, wherein the rocker arm and its mounting means are proportioned to lock the rocker arm for limited pivotal movement about a fixed axis in the loaded configuration and yet permit removal of the rocker arm only in the unloaded configuration, whereby the rocker arm can be removably secured to coact with the spherical headed bolt, and whereby the spring assembly may be inserted into a frame bolt and the rocker engaging the spring and a rail with the rocker removably secured by its mounting on the spherical headed bolt through the keyhole slot.

3. For use in a sliding gate valve having a mounting plate and a frame secured to the mounting plate, said valve containing a plurality of refractory plates interiorly thereof, the lower one of said plates having a mounting rail for engagement by a rocker arm, a rocker arm spring assembly comprising, in combination, a rocker arm for engaging said lower plate mounting rail, means for mounting the rocker arm to the frame, a spring pad assembly engaging the opposite end of the rocker arm from the rail engaging portion thereof, wherein said rocker arm includes a keyhole slot having a mounting seat for the means for mounting the rocker arm beneath a bolt shank slot, wherein the rocker arm and its mounting means are proportioned to lock the rocker arm for limited pivotal movement about a fixed axis in the loaded configuration and yet permit removal of the rocker arm only in the unloaded configuration, said spring being carried by a spring pad and shank, said frame having a bore for receiving the spring pad and its associated spring, whereby upon unloading the refractory from said valve, the rocker arm can be shifted laterally via the keyhole mounting slot, and the spring assembly removed from the bore for inspection, or replacement.

4. In the rocker arm/spring assembly of claim 3, said spring pad terminating in a shank head, and a cup-shaped spring seat for receiving said head and retaining said head to thereby insure an assembled relationship between the spring and its associated pad and shank as a single pad assembly.

5. In the rocker arm/spring assembly of claim 3, said rocker arm having a central bolt shank slot slightly larger than the shank of the mounting bolt, and laterally therefrom a throughbore bolt had port of slightly larger diameter than the bolt head of the rocker bolt.

* * * * *